United States Patent [19]

Ohfuji

[11] 3,994,088

[45] Nov. 30, 1976

[54] PHOTOGRAPH MOUNTS FOR ALBUM

[76] Inventor: Tadao Ohfuji, 8-7, 8-Chome, Akasaka, Minato, Tokyo, Japan

[22] Filed: June 2, 1975

[21] Appl. No.: 583,095

Related U.S. Application Data

[63] Continuation of Ser. No. 380,950, July 20, 1973, abandoned.

[30] Foreign Application Priority Data

July 25, 1972 Japan ..... 47-86930

[52] U.S. Cl. ..... 40/158 R; 40/104.18

[51] Int. Cl.[2] ..... G09F 1/10

[58] Field of Search ..... 40/158, 158 B, 125 A, 40/104.18; 428/40, 41

[56] References Cited

UNITED STATES PATENTS

| | | | |
|---|---|---|---|
| 2,292,272 | 8/1942 | Hirshfield | 40/125 A X |
| 3,670,434 | 6/1972 | Shibata | 40/158 |

*Primary Examiner*—Hugh R. Chamblee
*Assistant Examiner*—Wenceslao J. Contreras
*Attorney, Agent, or Firm*—Haseltine, Lake & Waters

[57] ABSTRACT

A photograph mount for an album comprising a pasteboard of rectangular configuration with a first non-drying adhesive material coated on both surfaces of the pasteboard in the form of lines extending parallel to one another and perpendicularly to a filing side edge of the pasteboard. A second non-drying adhesive material is coated on both surfaces of the pasteboard in the form of lines extending parallel with the side edge and perpendicularly to the lines of the first adhesive material. The lines of second adhesive material are proximate the aforesaid other side edge of the pasteboard and are discontinuous from the lines of first adhesive material. A first synthetic resin film is press-fitted on the adhesive in a first region where filing holes are formed in the pasteboard and a second transparent synthetic resin film is press-adhered to the adhesive and folded around the opposite edge of the pasteboard with free edges superimposed on respective edges of the first synthetic resin film.

3 Claims, 2 Drawing Figures

PHOTOGRAPH MOUNTS FOR ALBUM

CROSS-RELATED APPLICATION

This application is a continuation of copending application Ser. No. 380,950 filed July 20, 1973, now abandoned and claims the priority of the application filed in Japan on July 25, 1972.

This invention relates to a photograph mount for album of the kind that a transparent synthetic resin film is tentatively adhered to a non-drying adhesive which has been coated on both sides of a pasteboard.

A conventional photograph mount for album of this kind has such construction that a transparent synthetic resin film is tentatively adhered to a non-drying adhesive coated on both sides of a pasteboard, said film being cut at portions near the filing holes of the pasteboard so that both edges of the film are in contact with each other at said cut portions and are closely adhered to the adhesive on the pasteboard. When photographs are desired to be mounted on said mount, therefore, not only the film is quite difficultly peeled at its edges which are in contact with said cut portions, but also even the surface layer of the pasteboard is liable to be peeled off at the time of peeling the film from the pasteboard. Further, when relatively thick materials are inserted between the pasteboard and the film, a gap is formed between the two edges of the film at said cut portions, with the result that dust and dirt adhere to the adhesive at said gap to contaminate the pasteboard.

If the synthetic resin film has been so adhered to the pasteboard as to be completely peeled even to the folded portion at the edge of the pasteboard, the film, after mounting photographs on the pasteboard, is quite difficultly press-adhered again to the pasteboard so as to maintain its original beautiful form. In order to overcome this disadvantage, the conventional photograph mount for album has been so constructed that by thermal fusion or by use of an adhesive, the folded portion of the film is firmly bonded to the end portion of the pasteboard so as not to be peeled off therefrom. Due to such construction, the conventional photograph mount has had such disadvantages that the film is undesirably deformed at the time of thermally fusing the folded portion of the film to the end postion of the pasteboard, and that when the film is peeled from the pasteboard, a linear crease is formed in the film at the portion where the film has been firmly bonded to the pasteboard, with the result that the film cannot completely be press-adhered again to the pasteboard.

An object of the present invention is to provide a photograph mount for album having a simple and convenient construction which has completely been freed from all such disadvantages of the conventional photograph mount as mentioned above.

Figure 1:
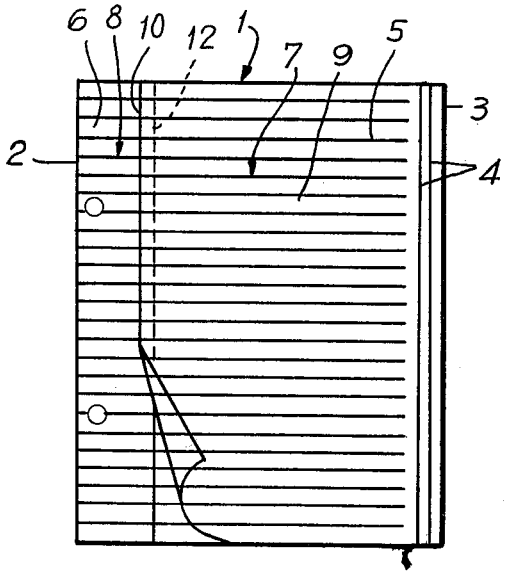
Figure 2:
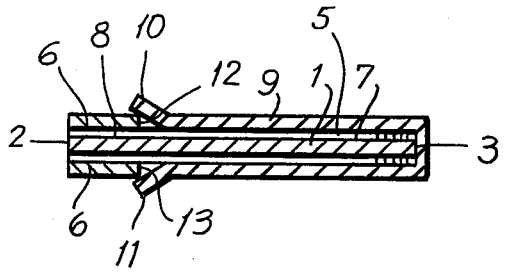

The present invention is explained below with reference to an example shown in the accompanying drawings, in which FIG. 1 is a plane view of an example of the photograph mount for album according to the present invention, and FIG. 2 is a cross-sectional view of the photograph mount shown in FIG. 1.

The photograph mount for album of the present invention comprises a pasteboard 1, a non-drying adhesive coated onto both sides of said pasteboard 1, a first synthetic resin film 6, and a second transparent synthetic resin film 9, and has such construction that the non-drying adhesive is coated on each side of the pasteboard 1 so as to form two spaced adhesive lines 4 which are close to and which extend parallel to the edge 3 opposite to the filing edge 2 of the pasteboard 1; the same non-drying adhesive as above is coated to the form of a plurality of mutually spaced lines 5 on each side of the pasteboard 1 at the portion between the said filing edge 2 and the said adhesive lines 4, said plurality of lines 5 being substantially perpendicular to said adhesive lines 4; the first synthetic resin film 6 is press-adhered onto the portion bearing the adhesive lines 5 in the filing region 8 on each side of the pasteboard 1 so that the film extends from the filing edge 2 to the photograph-mounting region 7 of the pasteboard 1; and the second transparent synthetic resin film is tentatively adhered to the adhesive lines 4 and to the portion of the adhesive lines 5 in the photograph-mounting region 7 on each side of the pasteboard 1 and, at the same time, the end portions 10 and 11 of the second film 9 are superposed, respectively, on the end portions 12 and 13 on the first film 6.

The present photographic mount having such construction as above is actually used in the following manner:

As shown in FIG. 1, the second film 9 is peeled from the adhesive lines 5 on the pasteboard 1, while holding one end of the end portion 10 or 11 of the film 9 which has been superposed on the end portion 12 or 13 of the first film 6. At the initial stage of peeling, the direction of peeling of the film 9 is slant to the lines 5. As the peeling progresses, however, the direction of peeling of the film 9 becomes parallel to the lines 5, so that the film 9 can be peeled to a portion immediately before the inner line 4 with a relatively weak force. When the peeling of the film 9 has progressed to the inner line 4, a relatively strong resisting force is felt to the hand holding the film 9. Accordingly, the peeling of the film 9 is discontinued at this stage, whereby the film 9 is not peeled beyond the inner line 4 to the edge 3 of the pasteboard 1. Further, one who handles the photograph mount can clearly see the longitudinal lines 4, so that the film-peeling operation can be controlled by sight, as well.

The width of each of the end portions 10 and 11 of the second film 9 which are to be superposed on the end portions 12 and 13 of the first film 6 is optional, but is preferably from 3 to 5 mm. While the above-mentioned example shows the case where two adhesive lines 4 are formed on each side of the pasteboard 1, the width and number of the adhesive lines 4 may optionally be decided. Further, it will be understood that the adhesive lines 5 may be in the form of dotted lines, and may be slant to the lines 4, and that the adhesive may be coated on the whole surface of each side of the pasteboard 1, except the end portions bearing the lines 4.

As mentioned above, the photograph mount of the present invention is so constructed that the end portions 10 and 11 of the second film 9 have not been adhered to the adhesive on the pasteboard 1 but have been superposed, respectively, on the end portions 12 and 13 of the first film 6, and have been slightly elevated upwardly by means of the edges of the end portions 12 and 13 of the first film 6. Accordingly, the photograph mount of the present device has many such advantages as mentioned below.

Even if the second film has shrunk due to temperature variation, or even if relatively thick materials have been inserted between the film and the pasteboard, no gap is formed between the end portions of the first and second films. Even if the film has elongated due to temperature variation, the said elongation can be freed to form no wrinkle in the film. The end portions of the second film can be clearly observed by the eyes, and the photograph-mounting operation can be conducted quickly. The photograph mount does not form any such crease as seen in the conventional photograph mount, in which a transparent film has firmly been bonded to the end portion of a pasteboard. Further, the photograph mount can be prevented from such danger that the second film is peeled even to the folded portion of the second film at the edge 3 of the pasteboard to form a crease in the second film.

What I claim is:

1. A photograph mount for an album comprising a pasteboard of rectangular configuration having a filing side edge and a remote opposite side edge, a first non-drying releasable adhesive material coated on both surfaces of said pasteboard in the form of lines extending parallel to one another and perpendicularly to said filing side edge of said pasteboard, said lines constituting photograph-mounting regions, a second non-drying releasable adhesive material coated on both surfaces of said pasteboard in the form of lines extending parallel with the other side edge and perpendicularly to said lines of said first adhesive material, said second adhesive material being discontinuous from said first adhesive material, a first synthetic resin film and a second transparent synthetic resin film, the first synthetic resin film being press-adhered to the adhesive on each side of the pasteboard so as to extend from the filing side edge of the pasteboard to the photograph-mounting region on each side of the pasteboard, the second transparent synthetic resin film being removably adhered to the first adhesive in the photograph mounting region on each side of the pasteboard, and being removably adhered to the second adhesive and being folded at said opposite side edge of the pasteboard, the end portions of said second synthetic resin film being superposed, respectively, on the end portions of the first synthetic resin film, said lines of second adhesive material being confined to said region of the pasteboard proximate said remote edge, said lines of first adhesive extending from the region of the lines of second adhesive towards said filing side edge, said end portions of said second film being overlapped on and raised above the level of the first film so as to be bent from the remainder of the second film.

2. A photographic mount as claimed in claim 1 wherein said lines of first adhesive have edges facing the lines of second adhesive and disposed along a common line spaced from said lines of second adhesive and parallel thereto.

3. A photograph mount as claimed in claim 1 wherein said end portions of the second film have free edges which are disposed above the first film in spaced relation and are inclined upwardly.

* * * * *